US006050215A

United States Patent [19]

Koulik et al.

[11] Patent Number: 6,050,215

[45] Date of Patent: Apr. 18, 2000

[54] PLASMA STREAM GENERATOR WITH A CLOSED CONFIGURATION ARC

[75] Inventors: Pavel Koulik; Rudolph Konavko; Anatolii Saishenko; Mikhail Samsonov, all of Yverdon-les-Bains, Switzerland

[73] Assignee: IST Instant Surface Technology S.A., Switzerland

[21] Appl. No.: 09/068,415

[22] PCT Filed: Nov. 12, 1996

[86] PCT No.: PCT/CH96/00403

§ 371 Date: Sep. 8, 1998

§ 102(e) Date: Sep. 8, 1998

[87] PCT Pub. No.: WO97/18693

PCT Pub. Date: May 22, 1997

[30] Foreign Application Priority Data

Nov. 13, 1995 [CH] Switzerland ..... 3210/95

[51] Int. Cl.[7] ..... H05H 1/44

[52] U.S. Cl. ..... 118/723 R; 310/11; 219/121 PR

[58] Field of Search ..... 310/11; 219/121 PR

[56] References Cited

U.S. PATENT DOCUMENTS 3,940,641 2/1976 Dooley ..... 310/11

4,275,287 6/1981 Hiratake ..... 219/121 PR

*Primary Examiner*—Bruce Breneman

*Assistant Examiner*—Rudy Zervigon

*Attorney, Agent, or Firm*—Clifford W. Browning; Woodard, Emhardt, Naughton Moriarty & McNett

[57] ABSTRACT

A plasma stream generator with a closed-configuration arc for achieving a stream comprising a central area at a uniform or very low temperature. The generator comprises a higher or even much higher number of electrode pairs than is usual, whereby rows may be formed and, in particular, an elongate stream, i.e. a curtain, may be achieved. The orientation problems resulting from the closeness of the jets and the increased attraction/repulsion therebetween are solved by means of magnetic devices (coils) of which there are generally three for a pair of electrode chambers.

13 Claims, 3 Drawing Sheets

PLASMA STREAM GENERATOR WITH A CLOSED CONFIGURATION ARC

Figure 1:
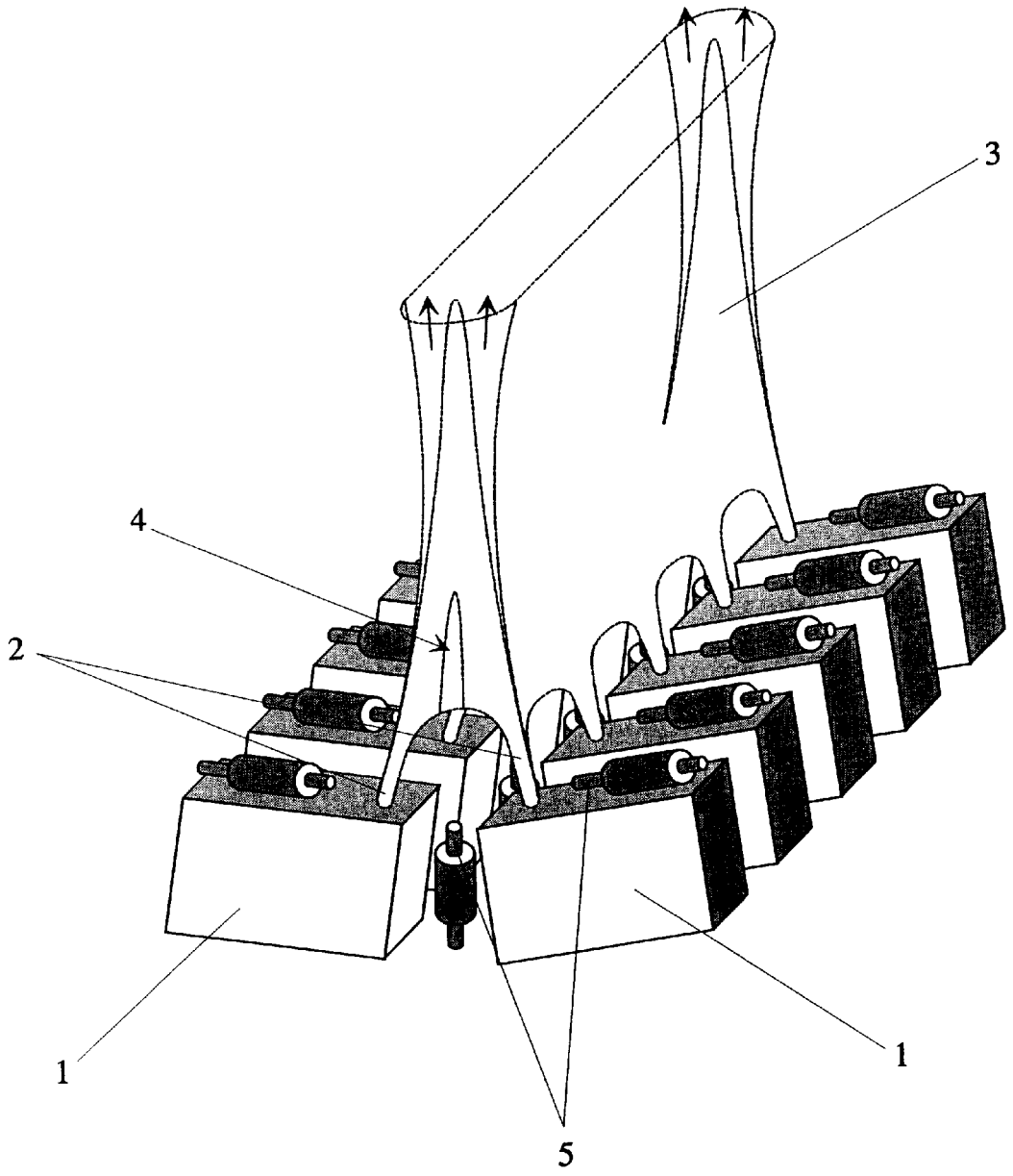

This invention concerns a plasma arc stream generator with a closed configuration.

Plasma technology, and in particular devices for creating a stream of closed configuration may be used in surface treatment processes (sterilization, cleaning, etching, modifying, deposit of coatings and films) of monolithic and disperse materials, and for obtaining and treating chemical products, in electronics, the automotive industry, metallurgy, the chemical and food industry, medicine and many other sectors.

This type of device for generating a plasma arc stream of closed configuration with a central zone of uniform or lowered temperature is already known. This device is illustrated in the document entitled <<Basis for execution of a dynamic plasma treatment method for solid surfaces>>, by P. P. Koulik et al, <<Plasmokhimia 1987", Moscow 1987, part 2, pp. 58 to 96.

The abovementioned document describes a device containing two pairs of electrode chambers (cathodes and anodes) connected in pairs to DC power sources. The parameters of the plasma channels of the electrode chambers (cathodes and anodes) correspond to the data published in the document entitled <<Twin-jet plasmatron>>, Genbaiev G. G. and Enguelsht V. S., Frounze 1983.

When the electrode chambers are energized, two arcs are activated and form four plasma jets with the current passing through them. The spatial orientation of the plasma jets is obtained by external magnetic fields directed in relation to the electrode chambers such that the plasma jets from the electrode chambers converge and form a common stream of axially symmetrical plasma, with the current passing through (plasma funnel) whose section, perpendicular to the axis of symmetry of the stream, has a unifrom or lowered temperature zone in relation to the peripheral part of the stream.

It is into this zone that the gaseous, disperse or solid state components are injected via one or more concentric axial channels into the plasma funnel for conversion before use.

The advantage of this known type of plasma generator lies in the special configuration of the plasma stream. In fact, this is in the form of a plasma funnel, enabling the introduction and treatment (processing) by the plasma of different products in different forms (gaseous, liquid or solid), and use of this generator for high performance surface sterilization, cleaning, etching, modifying and also coating with films.

The disadvantage of the generator of the above type is that the plasma stream is always of reduced dimensions, dictated by the diameter of the resultant plasma stream. However, there are numerous applications for which a larger sized plasma stream would be useful, provided of course that the closed configuration of the stream is maintained, as this affords a central zone of uniform or lowered temperature.

The purpose of this invention is to offer a plasma arc stream generator of closed configuration, whose section, perpendicular to the direction of the stream, is elongated in form (plasma curtain) affording a central zone of uniform or lowered temperature.

To this effect, the invention concerns a plasma arc stream generator of closed configuration, comprising electrode chambers working in pairs, each pair having an anode and a cathode and being connected to a DC source, with the current passing through the plasma jets generated, whose spatial orientation is obtained by means of an external magnetic field directed such that the plasma jets from the chambers converge and form a common plasma stream with a central zone of uniform or lowered temperature, the said generator comprising at least three pairs of electrode chambers as above, with the said chambers positioned in relation to each other so that the assembly is symmetrical without, however, the chambers being positioned on the same circle.

According to one embodiment, the generator further comprises one or more magnetic orientation devices (for the jets) outside all the electrode chambers, the generator creating a common plasma stream of closed configuration, elongated in shape with a central zone of uniform or lowered temperature in relation to the peripheral zone resulting from convergence of at least six plasma jets.

The magnetic device dictating the orientation of the plasma jets may consist, for each electrode chamber, of three sections of magnetic conductor, two of which are positioned perpendicular to the plasma jets and the third between the plasma jets.

The electrode chambers may be positioned in two groups, the two groups of chambers possibly being arranged in parallel rows, the rows possibly being straight.

According to one variant, the electrodes in one and the same group, respectively in one and the same row, of chambers are all of the same polarity, the electrode chambers of one and the same group or same row respectively possibly being constructed in a single, continuous block.

According to another variant, one and the same group, or same row respectively, of chambers contains electrodes of opposite polarity, the electrodes in any one group or row being positioned such that they are of alternating polarities, at least partially.

The solution proposed in this invention basically consists in equipping the generator with at least one pair of electrode chambers (anodes and cathodes) in addition to of the generator known from the <<Koulik>> document referred to above.

Figure 2:
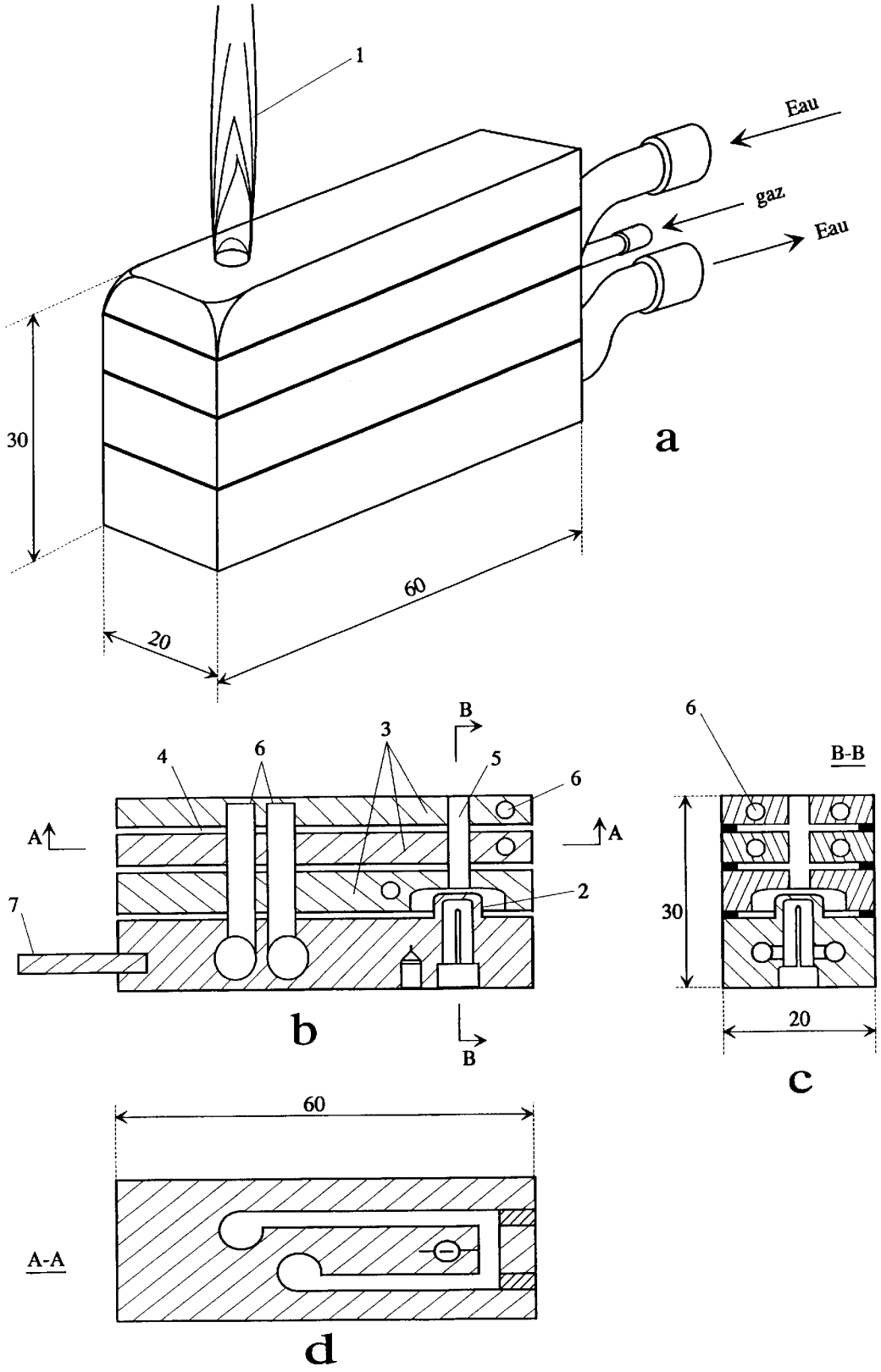
Figure 3:
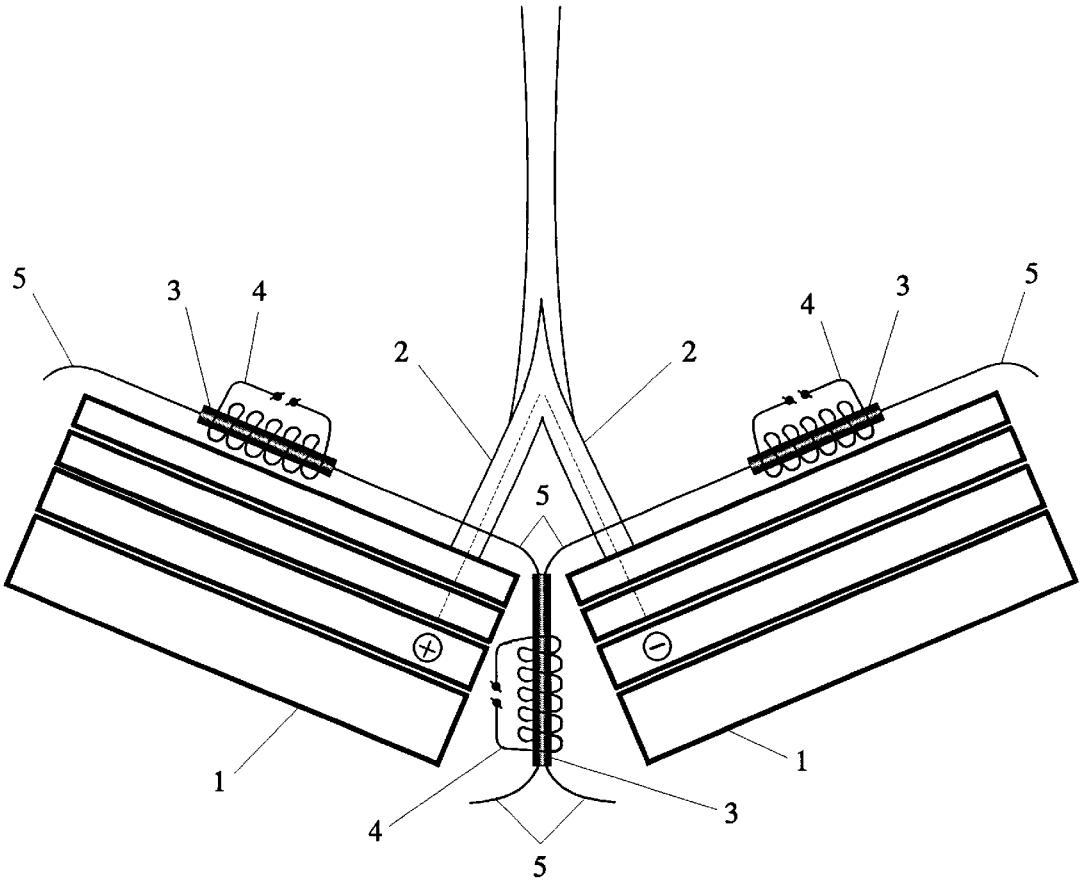

A description is given below of the generator according to the invention, based on the drawing in which:

FIG. 1 shows the generator according to the invention, constructed such that the electrode chambers are arranged in two parallel straight lines; the references in FIG. 1 are as follows:

1. Electrode chambers
2. Plasma jets
3. Resulting plasma stream
4. Plasma stream zone of lowered temperature
5. Magnetic conductors with winding coils FIG. 2 shows an electrode chamber in the form of a relatively narrow parallelepiped according to the invention, and more particularly the following details: FIG. 2*a*—general arrangement, FIGS. 2*b* to 2*d*—sections; the references relating to FIG. 2 are as follows:

1. Plasma jet
2. Electrode
3. Diaphragm
4. Dielectric seal
5. Current channel
6. Water cooling ducts
7. Electric power supply cable FIG. 3 is a diagrammatic view showing the orientation of the plasma jet magnetic control device, in the plane of the jets, according to the invention; the references relating to FIG. 3 are as follows:

1. Electrode chamber (anode, cathode)
2. Plasma jets
3. Magnetic conductor
4. Winding coils
5. Magnetic lines Looking at FIG. 1, it will be noted that the electrode chambers are connected in pairs (consisting of an anode with a cathode) to current sources. The proposed plasma generator comprises at least six electrode chambers generating six plasma jets with the current passing through them. The orientation of the electrode chambers is designed to create a plasma curtain and not, as in the prior art design, to merely form a plasma funnel. As in the <<Koulik>> document referred to above, firstly the orientation of the resulting plasma stream and secondly determination of the shape of the stream are dictated by means of external magnetic fields. These magnetic fields are directed in relation to the electrode chambers such that the plasma streams emerging from the electrode chambers form a common plasma stream that is symmetrical in relation to a given surface, with the currents from the electrode chambers passing through (plasma curtain).

Different arrangements of the electrode chambers are possible along surfaces of different symmetry; cone of circular or elliptical section, parallel planes, single planes, etc. Depending on this arrangement, different plasma stream configurations can be obtained that can be adapted to suit different practical solutions, and hence different applications.

The arrangement which warrants closest attention is that in which the electrode chambers are positioned in two parallel lines, situated in two planes which intersect. In this case, a single plasma stream is fomed, obtained by the convergence of the initial plasma jet zones from the electrode chambers, whose temperature is high, and the plasma stream resulting in a flat curtain affording a zone of uniform or lowered temperature in its centre.

The arrangement of the electrode chambers in two rows can be determined such that in each row the anode and cathode chambers alternate, or the electrodes in any one row are all of the same type, i.e. all needs or all cathodes.

The channels of the electrode chambers through which the current passes consist of copper diaphragms with dielectric seals. The electrodes themselves (copper anode, tungsten cathode) are positioned at the entry to the current channels. All the parts in the electrode chambers are water-cooled. The gas forming the plasma passes through the current channels. The diameter of the electrodes and the diaphragms, and the thickness and number of these, is optimised to obtain plasma jets of high stability.

The spatial orientation of the plasma jets is controlled by magnetic field. This orientation control is designed to force the plasma jets to remain in the direction dictated by the current channel.

Under the action of their particular magnetic fileds, the plasma jets mutually repel each other when they are of opposite polarity, and attract in the reverse case.

When the electrode chambers are of the same polarity in a row, the mutual attraction of the jets (in the absence of external magnetic fields) means that the plasma jets at the ends of the row have a substantial inclination to the centre of the row. The external magnetic field, i.e. the control referred to above, should this in case counteract this attraction and re-establish the direction of the plasma jets dictated by the current channel.

If the polarities of the jets in the same line alternate, the plasma jets repel each other, causing a change in distance between the different jets downstream of the electrode chambers, or inevitable slight differences in gas flowrate and current between the various plasma jets.

The application of external magnetic fields enables achievement of the required orientation characteristics of the plasma jets and to a large extent corrects the effects due to their proximity. At any event, the magnetic force should be orientated in the plane of the plasma jets, perpendicular to their direction of flow.

Looking at FIG. 3, the magnetic device for control of the jets can be seen, which, in the plane of the jets, contains three sectors of magnetic conductors with winding coils. The direction of the current in the coils is consistent with the direction of action on the plasma jets.

The size of the field can be selected individually for each plasma jet by varying the current in the coils. The magnetic device is installed separtely for each pair of electrode chambers (anode and cathode). The magnetic conductor situated between the plasma jets may coincide with the system for introducing the chemical product or treated product into the plasma curtain.

The arrangment of the chambers in rows, with alternating polarity in the row, simplifies magnetic control as the jets with the current passing through partially compensate the specific magnetic field (with the exception of the end jets).

Nonetheless, in view of the risk of short-circuit between chambers of different polarity, the distance between them should ensure that any such short-circuit is ruled out. This means increasing the distance between the plasma jets and moving their point of convergence towards the areas of lowest temperature.

The arrangement of the chambers in rows, with the same polarity for the entire row, requires more intense action on the jets by the external magnetic fields (especially on the end jets). However, the advantages of this arrangement is that the electrode chambers can be positioned one against the other, which reduces the distance between the jets and means that their point of confluence can be positioned in the high temperature zone of the plasma. In addition, it is possible in this case to have the electrode chambers in a single block and the diaphragms in a single unit. This also means a reduction in distance between the jets.

In a more precise embodiment, the electrode chambers are 2 cm wide and positioned one after the other. They are thus arranged in two parallel straight lines of constant polarity. The generator consists of 50 pairs of electrode chambers. The current passing in each pair of chambers is 50 A, the voltage is 100 V, the power factor of each jet being 5 kW, with a gas heat output of 50%.

The plasma curtain, downstream of the confluence point of the jets, has a total length of 1 m, a width of 1 cm and a total power factor of 125 kW.

We claim:

1. Plasma arc stream generator, of closed configuration, comprising electrode chambers working in pairs, each pair having an anode and a cathode and being connected to a DC power source, the plasma jets having current passing through them, with spatial orientation by means of an external magnetic field directed such that the plasma jets from the chambers converge and form a common plasma stream with a central zone of uniform or lowered temperature, characterised in that the generator comprises at least three pairs of electrode chambers as above, and the said chambers are arranged in relation to each other such that the assembly is symmetrical without all the chambers being positioned in the same circle, and in that said generator further comprises one or more magnetic orientation devices (of the jets) outside all the electrode chambers, the generator creating a common plasma stream of closed configuration, elongated in shape with a central zone of uniform or lowered temperature in relation to the peripheral zone resulting from the convergence of at least six plasma jets.

2. Generator according to claim 1, characterised in that the magnetic device dictating the orientation of the plasma jets consist, for each electrode chamber, of three sections of magnetic conductor, two of which being positioned perpendicular to the plasma jets and the third between the plasma jets.

3. Generator according to claim 1, characterised in that the electrode chambers are arranged in two groups.

4. Generator according to claim 3, characterised in that the two groups of chambers are arranged in parallel rows.

5. Generator according to claim 4, characterised in that the rows are straight.

6. Generator according to claim 5, characterised in that the electrodes in one and the same group or the same row of chambers respectively are all of the same polarity.

7. Generator according to claim 5, characterised in that one and the same group or same row of chambers respectively contains electrodes of opposite polarities.

8. Generator according to claim 7, characterised in that the electrodes in the same group or same row are arranged such that the polarities are alternated, at least partially.

9. Generator according to claim 5, characterised in that the electrode chambers in the same group, or same row respectively, are constructed in a single, continuous block.

10. Generator according to claim 1, characterised in that the electrodes in one and the same group or the same row of chambers respectively are all of the same polarity.

11. Generator according to claim 1, characterised in that one and the same group or same row of chambers respectively contains electrodes of opposite polarities.

12. Generator according to claim 11, characterised in that the electrodes in the same group or same row are arranged such that the polarities are alternated, at least partially.

13. Generator according to claim 1, characterised in that the electrode chambers in the same group, or same row respectively, are constructed in a single, continuous block.

* * * * *

UNITED STATES PATENT AND TRADEMARK OFFICE

CERTIFICATE OF CORRECTION

PATENT NO. : 6,050,215
DATED : April 18, 2000
INVENTOR(S) : Pabel Koulik, et al.

It is certified that error appears in the above-identified patent and that said Letters Patent is hereby corrected as shown below:

On the title page, add as the second inventor--Vladimir Enguelcht--.

In column 1,line 36, please change "unifrom" to --uniform--.

In column 2, line 36, before "of" please insert --the two pairs of electrode chambers (anodes and cathodes)--

In column 3, line 41, please change "needs" to --anodes--.

In column 3, line 63, please change "this in" to --in this--.

In column 4, line 17, please change "separtely" to --separately--.

In column 4, line 35, please change "advantages" to --advantage--.

Signed and Sealed this

Thirty-first Day of October, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 6,050,215
DATED : April 18, 2000
INVENTOR(S) : Pavel Koulik et al.

It is certified that error appears in the above-identified patent and that said Letters Patent is hereby corrected as shown below:

Title page,
Block 75, please add as the second inventor -- Vladimir Enguelcht --.

Column 1,
Line 36, please change "unifrom" to -- uniform --.

Column 2,
Line 3, please change ", the" to -- . The --.
Line 4, please change "comprising" to -- comprises --.
Line 7, please change the period to a comma and add the following:
-- and said generator further comprises one or more magnetic orientation devices (of the jets) outside all the electrode chambers, the generator creating a common plasma stream of closed configuration, elongated in shape with a central zone of uniform or lowered temperature in relation to the peripheral zone resulting from the convergence of at least six plasma jets. --
Line 36, before "of" please insert -- the two pairs of electrode chambers (anodes and cathodes) --.

Column 3,
Line 41, please change "needs" to -- anodes --.
Line 63, please change "this in" to -- in this --.

Column 4,
Line 17, please change "separtely" to -- separately --.
Line 35, please change "advantages" to -- advantage --.

This certificate supercedes Certificate of Correction issued October 31, 2000.

Signed and Sealed this

Ninth Day of October, 2001

*Attest:*

Nicholas P. Godici

*Attesting Officer*

NICHOLAS P. GODICI
*Acting Director of the United States Patent and Trademark Office*